US008596008B2

(12) United States Patent
Waters et al.

(10) Patent No.: US 8,596,008 B2
(45) Date of Patent: Dec. 3, 2013

(54) CANOPY SYSTEM AND GROUP SUSPENSION SYSTEM THEREFORE

(75) Inventors: James R. Waters, Lancaster, PA (US); James P. Rineer, Pequea, PA (US); Brian L. Springer, Lancaster, PA (US); William H. Frantz, Elizabethtown, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 12/157,248

(22) Filed: Jun. 9, 2008

(65) Prior Publication Data

US 2009/0000248 A1 Jan. 1, 2009

Related U.S. Application Data

(60) Provisional application No. 60/933,803, filed on Jun. 8, 2007.

(51) Int. Cl.
*E04B 2/00* (2006.01)

(52) U.S. Cl.
USPC ..... 52/506.06; 52/39; 52/506.05; 52/506.08; 52/506.09; 52/511

(58) Field of Classification Search
USPC ..... 52/39, 506.06, 506.08, 511, 506.01, 52/507, 506.05, 506.09, 510
See application file for complete search history.

(56) References Cited

U.S. PATENT DOCUMENTS

| | | | | | |
|---|---|---|---|---|---|
| 2,882,558 | A | * | 4/1959 | Jacobson et al. | 52/506.09 |
| 3,708,941 | A | * | 1/1973 | Cuckson | 52/506.08 |
| 3,729,891 | A | * | 5/1973 | Olsen | 52/663 |
| 3,782,065 | A | * | 1/1974 | Griffing | 52/39 |
| 3,817,014 | A | * | 6/1974 | Jones | 52/478 |
| 3,973,368 | A | | 8/1976 | Moeller | |
| 3,998,419 | A | * | 12/1976 | Semmerling | 248/323 |
| 4,089,146 | A | * | 5/1978 | Martinez | 52/506.08 |
| 4,438,613 | A | * | 3/1984 | Hintsa et al. | 52/506.09 |
| 4,463,537 | A | * | 8/1984 | Rodriquez et al. | 52/506.07 |
| 4,548,010 | A | * | 10/1985 | Hintsa | 52/506.09 |
| 4,640,075 | A | * | 2/1987 | Nuncio | 52/506.06 |
| 4,693,174 | A | * | 9/1987 | Anderson | 454/292 |
| 4,717,099 | A | * | 1/1988 | Hubbard | 248/57 |
| 4,744,188 | A | * | 5/1988 | Ahren | 52/506.07 |
| 5,024,034 | A | * | 6/1991 | Gailey | 52/506.07 |
| 5,241,799 | A | * | 9/1993 | Jahn | 52/506.06 |
| 5,279,090 | A | * | 1/1994 | Yamaguchi et al. | 52/506.08 |
| 5,428,930 | A | * | 7/1995 | Bagley et al. | 52/506.07 |
| 5,435,514 | A | * | 7/1995 | Kerr, Jr. | 248/343 |
| 5,535,566 | A | * | 7/1996 | Wilson et al. | 52/506.07 |
| 5,871,556 | A | * | 2/1999 | Jeanseau et al. | 55/385.2 |
| 6,092,777 | A | | 7/2000 | Kuntz | |
| 6,123,154 | A | * | 9/2000 | MacDonald et al. | 169/37 |
| 6,311,626 | B1 | * | 11/2001 | Roberts | 108/42 |
| 6,318,042 | B1 | * | 11/2001 | Bloom et al. | 52/506.07 |
| 6,907,938 | B2 | * | 6/2005 | MacDonald et al. | 169/43 |
| 7,681,370 | B2 | * | 3/2010 | Waters et al. | 52/506.08 |
| 7,798,341 | B2 | * | 9/2010 | Richardson et al. | 211/119 |
| 2005/0034402 | A1 | * | 2/2005 | Johnson | 52/506.08 |
| 2006/0070967 | A1 | * | 4/2006 | Schaubeck et al. | 211/187 |

* cited by examiner

*Primary Examiner* — Brian Glessner
*Assistant Examiner* — Joshua Ihezie

(57) ABSTRACT

A canopy system for use in the interior building environment. The canopy system of the invention meets seismic code requirements and includes a group suspension system for mechanically aligning and registering canopy modules relative one another. The system requires a minimum number of attachment points to the overhead building structure.

16 Claims, 4 Drawing Sheets

CANOPY SYSTEM AND GROUP SUSPENSION SYSTEM THEREFORE

CROSS REFERENCE TO RELATED APPLICATION

This application claims the benefit under 35 U.S.C. §119 (e) of U.S. provisional application Ser. No. 60/933,803, filed Jun. 8, 2007.

BACKGROUND OF THE INVENTION

The present invention is directed to a canopy system, and, more particularly, a canopy system which provides mechanical alignment and registration of the canopy modules when grouped together.

Exposed structure types of spaces which utilize suspended ceiling islands or ceiling canopies are in increasing demand. Such systems provide architects and designers with the ability to create unique and dramatic visual effects not available with continuous, wall-to-wall ceiling systems.

For aesthetic purposes, it is desirable for the ceiling canopies to have clean, finished edges free of any exposed, unsightly edge detail or fastening means. One solution for providing this desired edge detail is shown and described in U.S. Patent Application Publication No. 2007/0033902, entitled "Suspension Systems" (hereinafter "the 2007/0033902 application").

Canopy systems have unique code requirements which dictate the placement of the individual canopies relative one another. For example, in areas which experience seismic activity, each independently hung canopy, when hung in the ceiling space, must be spaced 18 inches apart from one another, as well as 18 inches apart from any other building component.

Additionally, irrespective of the level of seismic activity, there are additional installation concerns, including concerns regarding alignment and registration of canopies when grouped together in the ceiling space. Alignment and registration are currently achieved through careful installation which is time consuming, which, in turn, adds cost to the system. Another concern with current canopy systems is that they currently require several attachment points to the overhead building structure. Reduction in the number of hanging points will reduce installation time and cost as well as eliminate points of electrical and mechanical interference.

Thus, the present invention is directed to a system that meets the seismic code requirements and provides a means to mechanically align and register the individual canopies with one another. Also provided is a system having a minimum number of attachment points to the overhead building structure.

SUMMARY OF THE INVENTION

The present invention is directed to an improved canopy system. The system includes a grouping frame and at least one canopy module. The grouping frame includes at least two intersecting struts. The canopy module includes a panel and suspension hardware. The suspension hardware includes at least one suspension bar which is attached to the back surface of the panel at an in-board location. Each of the intersecting struts has a hook member attached thereto. Each hook member rests on, and is supported by, a strut.

When installed, the canopy module is locked to the grouping frame in both its longitudinal and cross axes. Additionally, the grouping frame and the attachment hardware of the canopy module works in combination to mechanically register and align two or more canopy modules relative one another.

The improved canopy system provides: downward accessibility; a rigid suspension system that complies with seismic codes; a mechanism for multiple individual canopies to act as one and be installed in close proximity; ease in installation in terms of panel spacing and alignment; and a reduction in the number of attachment points to the overhead building structure by 25-50%.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Referring now in greater detail to the figures, wherein like numerals refer to like parts throughout the drawings.

Figure 1:
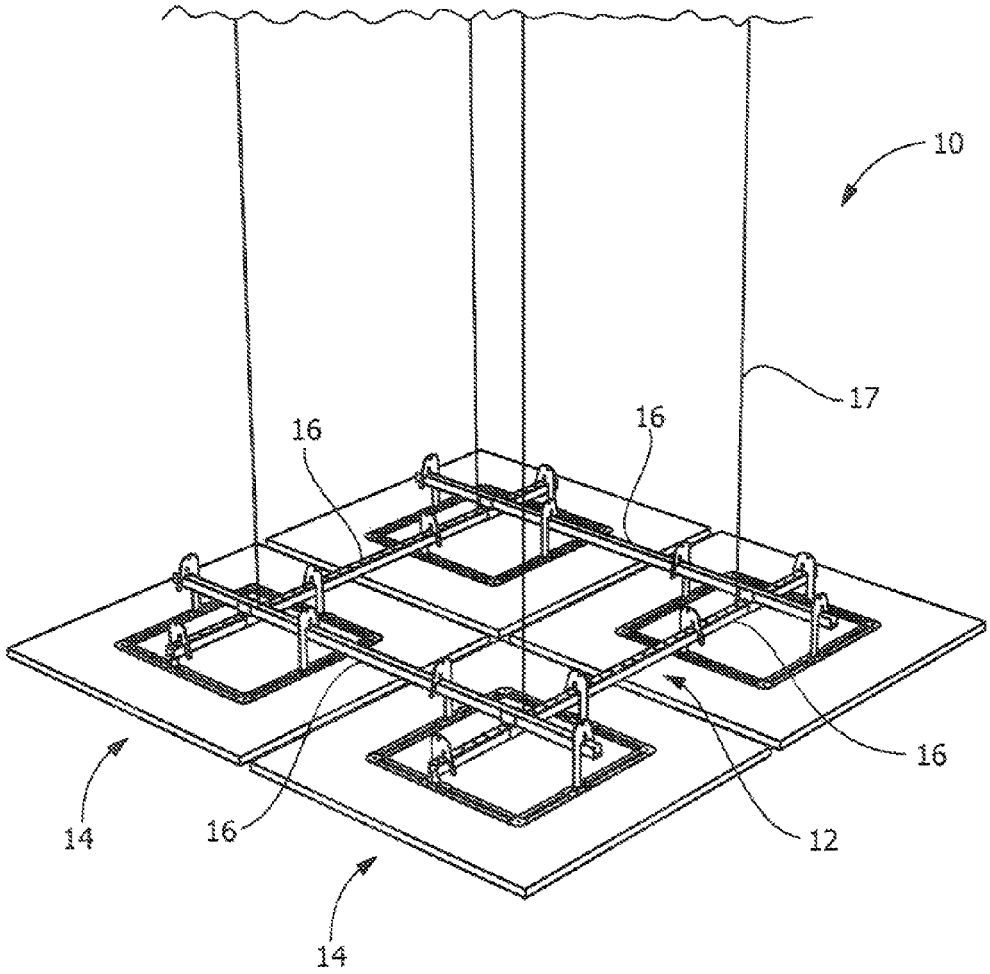
FIG. 1 is a perspective view illustrating an example embodiment of the canopy system of the invention.
Figure 2:
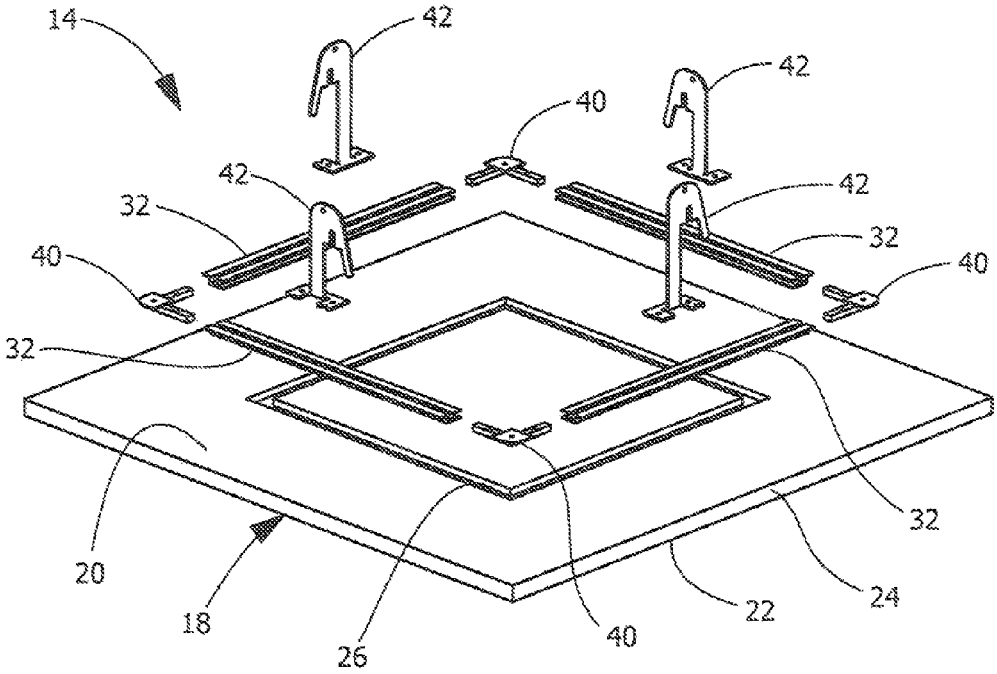
FIG. 2 is an exploded perspective view of a canopy module from FIG. 1.

FIGS. 1 and 2 illustrate the general structural arrangement of an example embodiment of the canopy system of the invention. The canopy system 10 includes a grouping frame 12 and one or more canopy modules 14. The grouping frame 12 has at least two intersecting struts 16 which are attached to one another and are supported by the overhead building structure (not shown) by a hanging device, such as the suspension cables 17 shown in FIG. 1.

As best seen on FIG. 2, the canopy module 14 has a panel 18, such as a fibrous acoustical panel or wood panel, which has a top surface 20, a bottom surface 22 and an edge 24 extending therebetween. The panel 18 includes a routed in-board channel 26 which extends from the top surface 20 in a direction toward the bottom surface 22. For purposes of this description, the term "in-board channel" refers to a channel that does not extend to an edge of the panel. This in-board feature substantially preserves the integrity of the panel and provides freedom of the edges. In other words, the edge configuration is not dictated by the support structure. Also, since the channel 26 does not extend to the edge of the panel 18, no further edge detail, such as a trim element, is required to finish the edge of the panel 18.

The canopy module 14 also includes suspension hardware, the components of which are best seen in FIGS. 2 and 3*a*-3*c*. The suspension hardware includes one or more longitudinally extending suspension bars 32 (See FIG. 3*b*). In the preferred configuration shown throughout the drawings, more than one suspension bar 32 is utilized. Here, the individual suspension bars 32 are mechanically attached to one another in the channel 26 to form an inter-locking continuous suspension bar. For example, the suspension bars can be attached via corner splices 40 (See FIG. 3*c*). When assembled to the panel, the suspension bars 32 provide rigid support for the panel in both the longitudinal and cross directional axes of the panel. Various types of suspension bars 32 can be utilized, including the extruded H-bar shown throughout the Figures and the conventional inverted-T grid members illustrated in the 2007/0033902 application.

Figure 3A:
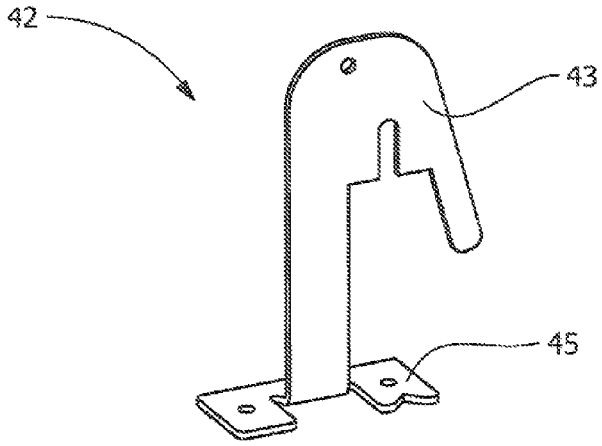
FIG. 3*a* is a perspective view of the hook shown in FIGS. 1 and 2.
Figure 3B:
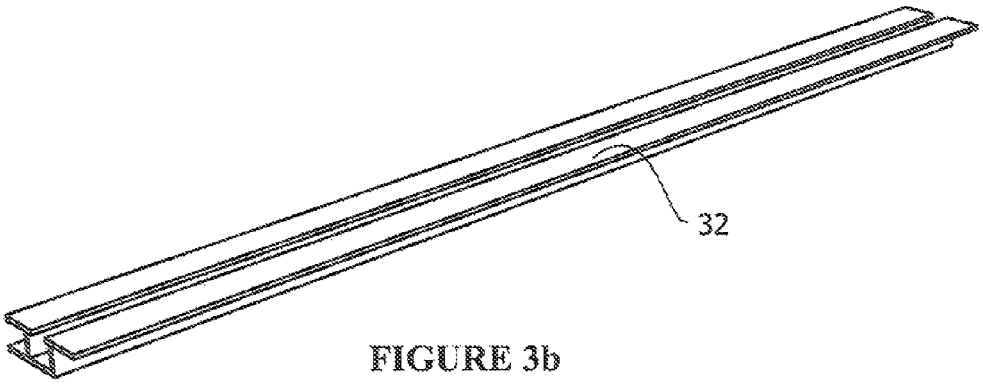
FIG. 3*b* is a perspective view of the suspension bar shown in FIGS. 1 and 2.
Figure 3C:
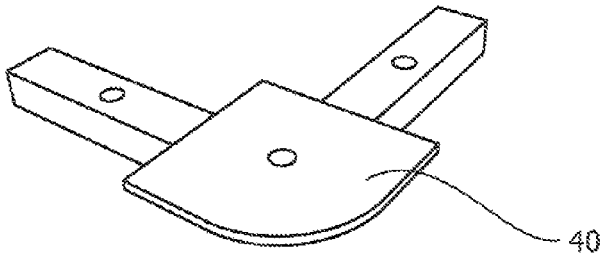
FIG. 3*c* is a perspective view of the suspension bar connector shown in FIGS. 1 and 2.

The suspension hardware also includes a plurality of hook members 42 which are fixedly attached to the longitudinally extending suspension bars 32 and extend therefrom in a direction generally perpendicular thereto. As best shown in FIG. 3*a*, the hook members 42 include a hook portion 43 at one end and an attachment flange 45 at the opposite end. The example hook members shown in the drawings are of general J shape and are preferably attached to the suspension bars 32 via the attachment flange 45 at an interior position of a respective suspension bar 32. Preferably, for a more fixed attachment, the hook portion 43 includes detailing which conforms to the shape of the intersecting struts 16 so that the hook member 42 will fit over and around, and ultimately rest upon, the intersecting struts 16. For example, the hook members are shown to be attached at the center of the suspension bar so that they will be attachable to the intersecting struts of the grouping frame as described in greater detail below.

The panel module 14 is installed on the grouping frame 12 by resting the hook members 42 over the struts 16 of the grouping frame 12. For ease of installation, the hook portion of the hook members all face the same direction, i.e. they each face in either the clockwise or counterclockwise direction. For illustration purposes, each hook portion of the hook members shown throughout the drawings face the counterclockwise direction.

Figure 4A:
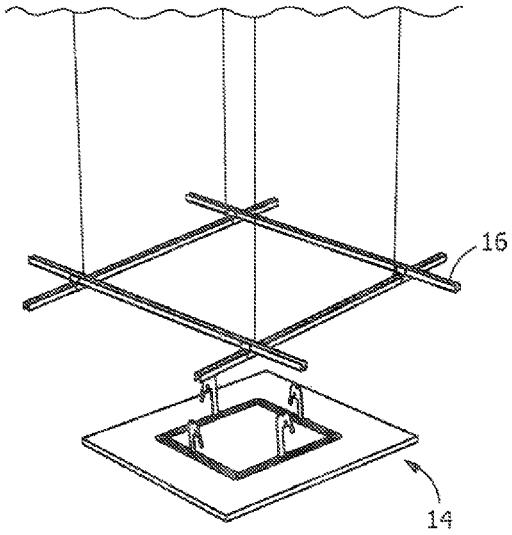
FIGS. 4*a* through 4*d* are perspective views showing the progressive steps in installing a canopy module in the system.
Figure 4B:
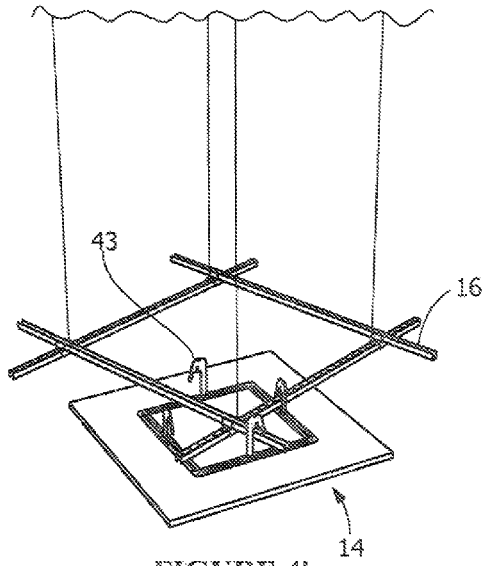
Figure 4C:
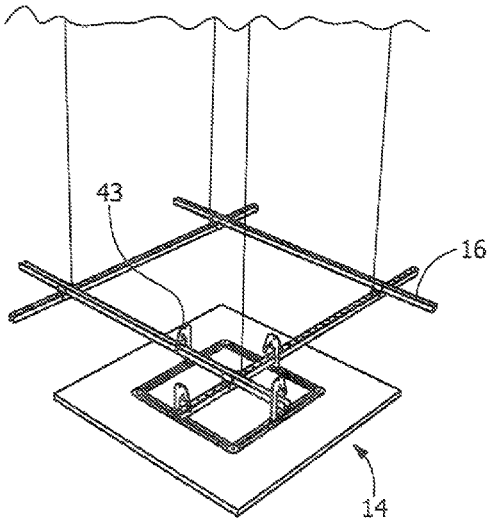
Figure 4D:
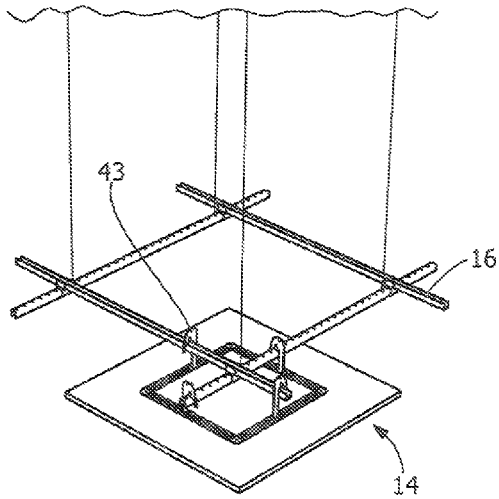

The progressive steps of attaching the canopy modules 14 onto the grouping frame are now described in greater detail with respect to FIGS. 4*a*-4*d*. As illustrated, the canopy modules 14 are downward accessible, i.e. the modules 14 are inserted up onto the grouping frame from a position below the grouping frame (as shown in FIG. 4*a*). As shown in FIG. 4*b*, the module is lifted upwardly until the hook portions 43 of all the hook members 42 are positioned above the intersecting struts 16. As shown in FIG. 4*c*, the module 14 is then rotated in a counterclockwise direction, i.e. the same direction in which the hook members are facing, until the hook portion of the hook members are positioned over the struts of the grouping frame. The struts 16 essentially act as a stop for movement of the canopy module in the counterclockwise direction. As shown in FIG. 4*d*, the module 14 is then allowed to drop down until the hook portion of the hook members engage, and rest upon, the intersecting struts 16.

The grouping frame 12, therefore, works in combination with the hook members 42 of the canopy module 14 to permit the modules to be easily locked onto the grouping frame in both the longitudinal and cross axes. Additionally, due to the installation procedure afforded by the components of the canopy modules, the modules can be installed on the grouping frame in close proximity to one another. Also, by attaching the modules to a grouping frame, the modules are indirectly attached to one another and are easily aligned and registered relative one another.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A canopy system comprising:

a grouping frame disposed in a horizontal plane and comprising a plurality of first struts and a plurality of second struts, the second struts intersecting the first struts at a plurality of junction points to form a grid network;

a plurality of panels, each of the panels positively attached to the grouping frame via a plurality of hook members comprising a first hook member having a first end coupled to the panel and a second end that rests upon one of the first struts and a second hook member having a first end that is coupled to the panel and a second end that rests upon one of the second struts, the panels being suspended beneath the grouping frame a distance;

wherein for each of the panels, the plurality of hook members are positioned a distance from the edge of the panel; and wherein for each of the panels, a center point of the panel is positioned in vertical alignment with one of the junction points.

2. The canopy system of claim 1 wherein for each of the panels, an in-board channel exists in a top surface of the panel, a suspension bar is disposed within the in-board channel and coupled to the panel, and the plurality of hook members are coupled to the suspension bar.

3. The canopy system of claim 2 wherein fir each of the panels, the plurality of hook members face in the same clockwise or counterclockwise direction relative to the center point of the panel.

4. The canopy system of claim 1 wherein for each of the panels, each of the plurality of hook members comprises a hook portion that is generally J-shaped.

5. The canopy system of claim 1 wherein for each of the panels, the plurality of hook members further comprise a third hook member that rests upon one of the first struts and a fourth hook member that rests upon one of the second struts.

6. The canopy system of claim 5 wherein for each of the panels, the first and third hook members are located along a first axis of the panel and the second and fourth hook members are located along a second axis of the panel, the first and second axes being orthogonal to one another and intersecting the center point.

7. The canopy system of claim 1 wherein the junction points are not points of positive attachment for the hook members.

8. A canopy system comprising:

a grouping frame disposed in a horizontal plane and comprising a plurality of first struts and a plurality of second struts, the second struts intersecting the first struts at a plurality of junction points to form a grid network.; and a plurality of panels, each of the panels positively attached to and suspended below the grouping frame a distance via suspension hardware comprising a first hook member, a second hook member, a third hook member, and a fourth hook member;

wherein for each of the panels, each of the first and third hook members engages one of the first struts and each of the second and fourth hook members engages one of the second struts.

9. The canopy system of claim 8 wherein for each of the panels, each of the first, second, third and fourth hook members are spaced from the center point.

10. The canopy system of claim 8 wherein for each of the panels, the center point is vertically aligned with one of the junction points.

11. The canopy system of claim 8 wherein for each of the panels, each of the first, second, third, and fourth hook members comprises to hook portion, the hook portions of the first and third hook members fitting over the first struts, and the hook portions of the second and fourth hook members fitting over the second struts.

12. The canopy system of claim 11 wherein for each of the panels, the hook portions of the first, second, third and fourth hook members all face in the same clockwise or counter-clockwise direction relative to the center point of the panel.

13. The canopy system of claim 11 wherein for each of the panels, the hook portions of the first, second, third and forth hook members are generally J-shaped.

14. The canopy system of claim 11 wherein the junction points are not points of positive attachment for the panels.

15. A canopy system comprising:

a grouping frame disposed in a horizontal plane and comprising a first strut and a second strut, the first and second struts intersecting at a junction point to form as grid network;

a panel positively attached to the grouping frame via a plurality of hook members that are coupled to the panel and engage the first and second struts, the panels being suspended beneath the grouping frame a distance;

wherein a center point of the panel is positioned in vertical alignment with the junction point; wherein the panel comprises a first axis and a second axis, the first and second axes being orthogonal to one another and intersecting the center point; and wherein the plurality of hook members are coupled to the panel at positions along the first and second axes.

16. The canopy system of claim 15 wherein the plurality of hook members are fitted over and rest upon the first and second struts.

* * * * *